US006926867B1

(12) United States Patent
Liu et al.

(10) Patent No.: US 6,926,867 B1
(45) Date of Patent: Aug. 9, 2005

(54) PIPETTE PISTON SEAL ASSEMBLY

(75) Inventors: Su Yi Liu, Sarasota, FL (US); Guo Chen Liu, Beijing (CN)

(73) Assignee: World Precision Instruments, Inc., Sarasota, FL (US)

( * ) Notice: Subject to any disclaimer, the term of this patent is extended or adjusted under 35 U.S.C. 154(b) by 322 days.

(21) Appl. No.: 10/003,537

(22) Filed: Oct. 30, 2001

(51) Int. Cl.[7] ..... B01L 3/02
(52) U.S. Cl. ..... 422/100; 73/864.13; 73/864.16
(58) Field of Search ..... 422/100; 73/864.13, 73/864.16

(56) References Cited

U.S. PATENT DOCUMENTS 3,827,305 A * 8/1974 Gilson et al. ..... 73/864.18
4,909,991 A * 3/1990 Oshikubo ..... 422/100
5,610,069 A * 3/1997 Clark et al. ..... 436/49
5,747,350 A * 5/1998 Sattler ..... 436/180

* cited by examiner

*Primary Examiner*—Jan M. Ludlow

(74) *Attorney, Agent, or Firm*—Alix, Yale & Ristas, LLP

(57) ABSTRACT

A piston seal assembly for a pipette includes an O-ring having radially inner and outer surfaces and axially separated first and second surfaces. A seal includes a radially extending rim portion having axially separated first and second surfaces and an axially extending sleeve portion forming an opening. A seat includes an axially extending indexing portion and a radially extending engagement portion forming an opening and having axially separated first and second surfaces. The seal is positioned such that the pipette piston extends through the opening and the radially inner surface of the sleeve portion slidably engages the piston. The seat is positioned such that the piston extends through the opening, the first and second surfaces of the engagement portion engage the second surface of the rim portion and an end of the spring, respectively, and the radially outer surface of the indexing portion engages the inner surface of the pipette body. The O-ring is positioned such that the sleeve portion of the seal extends axially through the opening of the O-ring, the radially inner surface of the O-ring engages the radially outer surface of the sleeve portion, the radially outer surface of the O-ring engages the radially inner surface of the indexing portion, the first surface of the O-ring engages a shoulder of the pipette body, and the second surface of the O-ring engages the first surface of the rim portion.

5 Claims, 1 Drawing Sheet

PIPETTE PISTON SEAL ASSEMBLY

BACKGROUND OF THE INVENTION

This invention relates generally to pipettes. More particularly the present invention relates to piston seals for pipettes.

Air displacement pipettes are widely used to transfer fluid samples in bioscience research, pharmaceutical manufacturing, and clinical analysis. The accuracy with which fluid is transferred is often critical to the outcome of the application. Failure to deliver fluid volumes accurately is a major concern for applications that require precise fluid volume transfer. Pipette failure usually occurs gradually with time and the frequency of pipette usage. Thus pipette failure may often be discovered too late to enable a quick and economical remedy. Users must therefore increase the frequency of pipette testing and calibration in order to assure continued fluid dispensing accuracy.

FDA registered companies adopt quality control procedures that require pipettes to be evaluated, maintained and recalibrated routinely at least every 6 months. Non-FDA registered institutions typically perform similar recalibration procedures every 12-months, or sooner. Most pipette manufacturers usually recommend that pipettes be serviced every 12 months. According to a recent technical report published by a leading U.S pipette manufacturer, pipettes tested on a routine 12-month basis exhibited a 20% failure rate for accurate volumetric delivery. The same report also stated that 60% of pipette failure is due to failure of the piston seal. Failure of the piston itself accounted for another 25% of the total and 15% was due to body failure. To reduce the failure rate, the report recommended replacing the piston seal every 6 months. It was further recommended that the piston and body be replaced every 3 years to ensure pipette reliability.

Failure of the seal can be attributed to a combination of 1) wearing of the seal with repeated use (abrasion); 2) separation of the seal from the piston over time due to "cold flow" or creep, and 3) the elasticity characteristics of the seal material. Although all three of these factors contribute to seal failure, the wearing of the seal, or its abrasion resistance, has been thought to be the most significant factor.

SUMMARY OF THE INVENTION

Briefly stated, the invention in a preferred form is a piston seal assembly for a pipette having a body, a piston, and a spring. The seal assembly comprises an O-ring, an integral, one-piece, substantially circular seal, and an integral, one-piece, substantially circular seat. The O-ring has radially inner and outer surfaces and axially separated first and second surfaces, with the radially inner surface forming an opening. The seal has a radially extending rim portion and an axially extending sleeve portion forming an opening. The sleeve has radially inner and outer surfaces and the rim portion has axially separated first and second surfaces. The seat has an axially extending indexing portion and a radially extending engagement portion forming an opening. The indexing portion has radially inner and outer surfaces and the engagement portion has axially separated first and second surfaces. The seal is positioned such that the rod segment of the piston extends through the opening and the radially inner surface of the sleeve portion slidably engages the rod segment. The seat is positioned such that the rod segment of the piston extends through the opening, the first and second surfaces of the engagement portion engage the second surface of the rim portion and an end of the spring, respectively, and the radially outer surface of the indexing portion engages the inner surface of the cavity. The O-ring is positioned between the shoulder of the body, the seat, and the seal such that the sleeve portion of the seal extends axially through the opening of the O-ring, the radially inner surface of the O-ring engages the radially outer surface of the sleeve portion, the radially outer surface of the O-ring engages the radially inner surface of the indexing portion, the first surface of the O-ring engages the shoulder, and the second surface of the O-ring engages the first surface of the rim portion. The O-ring is deformable by the biasing force of the spring such that the radially inner surface of the O-ring urges the sleeve portion of the seal into sealing engagement with the rod segment of the piston and the radially outer surface of the O-ring urges the indexing portion of the seat into sealing engagement with the inner surface of the cavity.

Preferably, the seal is composed of UHMWPE and the O-ring is composed of rubber.

It is an object of the invention to provide a new and improved piston seal assembly for pipettes.

It is also an object of the invention to provide a piston seal assembly for pipettes which is more resistant to degradation than conventional pipette piston seals.

Other objects and advantages of the invention will become apparent from the drawings and specification.

BRIEF DESCRIPTION OF THE DRAWING

The present invention may be better understood and its numerous objects and advantages will become apparent to those skilled in the art by reference to the accompanying drawing which is a cross-sectional view of a piston seal assembly in accordance with the invention, showing piston seal assembly installed in a pipette.

DETAILED DESCRIPTION OF THE PREFERRED EMBODIMENT

Figure 1:
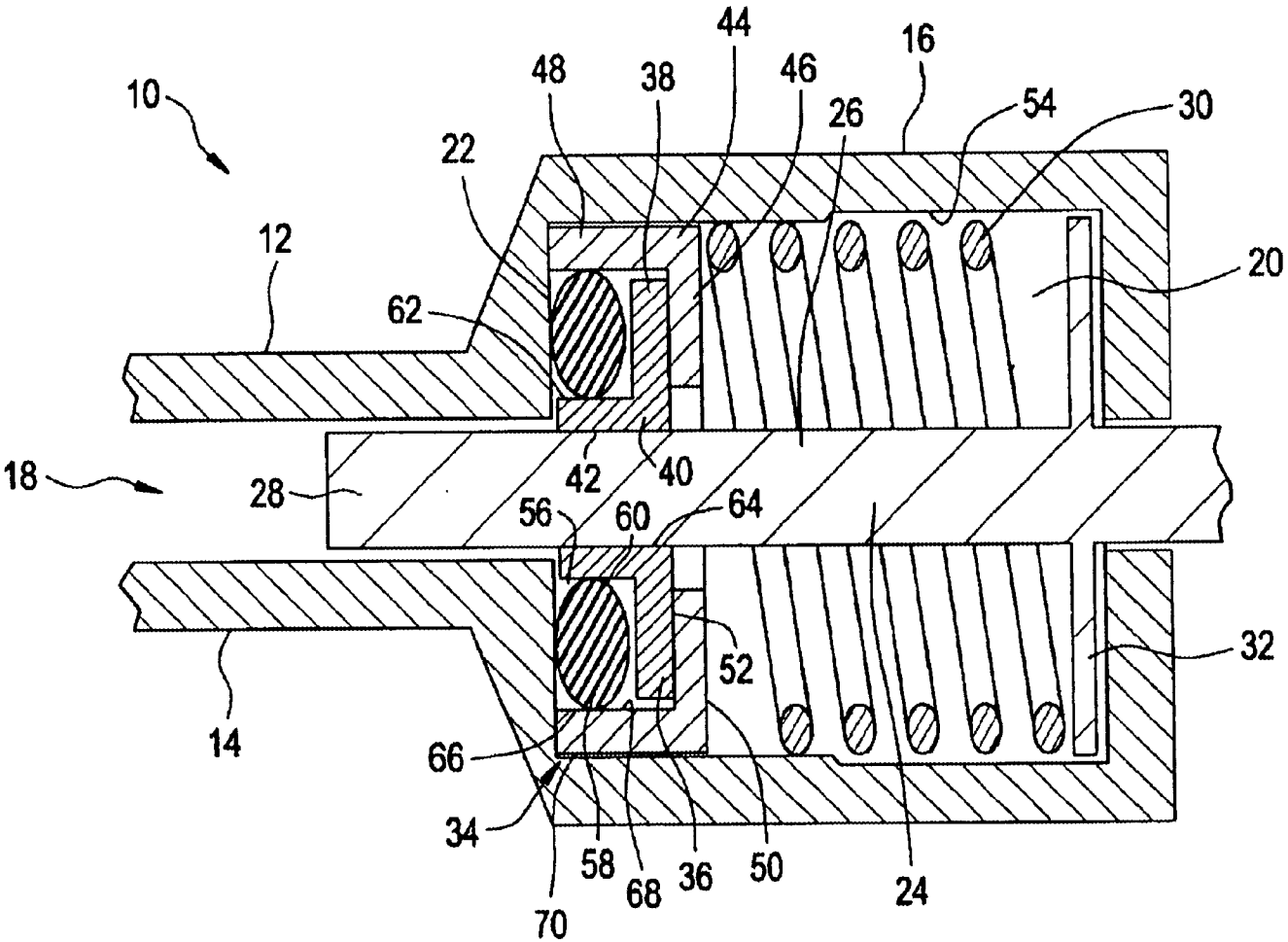

The piston seal used in pipettes has unique requirements that differ from those of piston seals used in liquid and air pumps. The piston of a pipette is depressed by finger action and returns by spring action. A light spring is easier to press and produces less user fatigue. Thus a very low friction seal is desired for most pipettes. If seal friction were too great, the user would have greater difficulty operating the piston. With very light springs the plunger can become stuck in the middle of its travel. Unlike seals used in air or liquid pumps, pipette seals must be airtight because pipettes are precision volume delivery devices which are expected to maintain error margins of less than 2% and exhibit no detectable piston air leakage for at least several minutes.

Due to these special requirements, conventional rubber high-friction O-ring seals cannot be used. Polytetrafluoroethylene (PTFE) is most commonly used in conventional seals. PTFE has a very low coefficient of friction, providing a seal which facilitates hand operation of the pipette. However, the operating life of PTFE seals has been found to be limited with air leakage past the seal generally occurring within a matter of several months. Previously, the failure mechanism of the PTFE seals was believed to primarily result from wear due to abrasion. Experimentation during the development of the subject invention has shown that such failure is primarily due to the creep characteristics of the PTFE material, where creep is the permanent distortion of the material under long-term static loads. Although a PTFE seal may be positioned tightly against the piston when first assembled, it gradually adapts to a new shape which will, in time, result in a loss of piston compression. The seal will then begin to leak air. Sealing grease may be used to fill gaps between the piston and the seal. However, with time the grease can migrate away from the gap because PTFE is not very "wet able" by grease.

Also, the grease can oxidize, becoming dry and allowing the seal to leak.

Polyethylene (PE) has also been used in conventional seals, having greater elasticity, lower creep, and about the same abrasion resistance as PTFE. Manufacture of pipettes with a PE seal do not favor the use of grease as a piston lubricant because PE is less chemically stable than PTFE, and grease could weaken its mechanical strength. However, in pipettes not having sealing grease any imperfection on the piston or seal, or even dust trapped in the seal could result in a slow leak.

With reference to the FIGURE, pipettes 10 are used to draw a measured quantity of a fluid from a first, source location, to transfer the fluid to a second location, and to discharge the fluid at the second location. The pipette 10 includes a pipette body 12 having a shaft segment 14 which extends from a tip (not shown) to a housing segment 16. The shaft segment 14 has a bore 18 which is coaxial with a cylindrical-shaped cavity 20 of the housing segment 16. The diameter of the cavity 20 is greater than the diameter of the bore 18, forming a shoulder 22 at the junction of the shaft and housing segments 14,16. The pipette 10 also includes a piston 24 having a rod segment 26 disposed within the body 12 and an operator segment (not shown) disposed exterior to the body. Generally, at least a tip portion 28 of the rod segment 26 is disposed within bore 18, as explained further below.

An operator pushes on the operator segment of the piston, inserting the rod segment 26 of the piston 24 further into bore 18 and expelling air for the bore 18. As the rod segment 26 is inserted, a spring 30 disposed between shoulder 22 and an engagement member 32 of the piston 24 is compressed. The tip of the shaft segment 14 is inserted into the fluid and the rod segment 26 is withdrawn from bore 18, creating a suction force, to draw the fluid into the pipette 10. Removing the pushing force from the operator segment allows the spring 30 to bias the engagement member 32 of the piston 24 away from shoulder 22 and to thereby withdraw rod segment 26 from bore 18. Indicia (not shown) on the shaft segment 14 provide a means of measuring the amount of fluid that is drawn.

Preferably, engagement member 32 contacts an inner portion of the housing segment to prevent the tip portion 28 of the rod segment 26 from being fully withdrawn from bore 18 and thereby prevent drawing fluid into cavity 20. Rod segment 26 is re-inserted into bore 18 to discharge the fluid.

Pipettes 10 are precision devices which are expected to maintain error margins of less than 2%. This level of precision requires that there must be no detectable piston air leakage for the period of time required to draw, transport, and discharge the liquid, a period of at least several minutes. A piston seal assembly 34 in accordance with the invention seals the piston 24 to the body 12, providing the necessary leak tightness.

The piston seal assembly 34 is positioned in cavity 20 and includes a one-piece circular seal 36 having a radially extending rim portion 38 and an axially extending sleeve portion 40. The seal 36 is positioned in cavity 20 such that the sleeve portion 40 extends from an end which is disposed proximate to shoulder 22, positioning the rim portion 38 at an axial distance from shoulder 22. The rod segment 26 of the piston 24 extends through an axial opening 42 in the sleeve portion 40. A circular seat 44 has an engagement portion 46 positioned by an indexing portion 48 intermediate the rim portion 38 of the seal 36 and spring 30. A first surface 50 of the engagement portion 46 is engaged by an end of the spring 30 and an opposite second surface 52 of the engagement portion 46 engages the rim portion 38 of the seal 36. The indexing portion 48 of the seat 44 is disposed intermediate the end of the rim portion 38 and the inside surface 54 of the housing segment 16. The sleeve portion 40 of the seal 36 extends axially through the opening 56 in an O-ring 58 such that the O-ring 58 is disposed intermediate shoulder 22 and rim portion 38 and intermediate sleeve portion 40 and indexing portion 48. Preferably, the O-ring 58 is composed of rubber.

The spring 30 applies pressure to the engagement portion 46 of seat 44. The force of the pressure is transmitted through the rim portion 38 of seal 36 to slightly compress the O-ring 58 against shoulder 22. The compression causes the O-ring 58 to bulge radially inward and outward such that the surface 60 of the O-ring 58 at opening 56 engages the radially-outer surface 62 of the sleeve portion 40 of the seal 36 urging the opposite, radially-inner surface 64 of the sleeve portion 40 into engagement with rod segment 26. In addition, the opposite, radially-outer surface 66 of the deformed O-ring 58 engages radially-inner surface 68 of indexing portion 48 urging the opposite, radially-outer surface 70 into engagement with surface 54 of housing segment 16. As a result, the O-ring 58 forms a seal with shoulder 22 and both the sleeve portion 40 and the rim portion 38 of the seal 36, and sleeve portion 40 forms a seal with rod segment 26.

Preferably, seal 36 is composed of an ultra-high molecular weight polyethylene (UHMWPE). UHMWPE has excellent chemical and solvent resistance characteristics, a coefficient of friction which is approximately the same or lower than that of PTFE. Unfortunately, it is very difficult to either mold or machine UHMWPE into parts having dimensions as small as is required for pipette seals, which militates against the use of such material for commercially produced pipette. However, UHMWPE has an abrasion resistance which is greater than the abrasion resistance of PTFE. Since the relatively low abrasion resistance of PTFE was believed to be responsible for the failure of PTFE seals, sample seals manufactured from UHMWPE were tested to determine whether such seals would have a correspondingly longer lifetime. The average lifetime of the UHMWPE seals was greater than was to be expected from the relative difference of the abrasion resistance. Further testing on the mechanical properties of PTFE and UHMWPE disclosed that creep was the failure mechanism for PTFE and that UHMWPE exhibits significantly less creep than PTFE, resulting in the longer lifetime.

In order to demonstrate that the subject seal is more durable than the other types of seals, pipettes 10 having the subject assembly 34 were tested on a pipette testing machine. The pipette-testing machine was made to continuously operate the pipette piston 24 at a speed and travel distance similar to pipette operation by hand. Leakage of the pipette 10 was tested using a Brinkman Pipette tester. A specified vacuum is generated and maintained for a minimum of 15 minutes to determine if any leakage can be detected by a high sensitivity vacuum gauge. The pipette 10 is also calibrated periodically by the gravimetric method to check the accuracy of sample fluid volumes. An excellent correlation between piston leakage of the pipette 10 and its accuracy exists. Therefore, only the leakage test was used to evaluate the condition of the seal. The durability of the seal 36 also depends on the seal size. Larger piston diameters have a larger circumferences. Therefore the chance of leakage is higher than for smaller piston seals. To make the tests consistent, all pipettes tested had a maximum volume of 1 ml.

Testing showed that pipettes 10 with the subject assembly 34 showed no leakage after as many as 10 million cycles. By contrast, an identical pipette with a conventional seal composed of PTFE failed after 250,000 cycles. Pipettes from four different manufactures, with PTFE seals, had lifetimes between 100,000 to 500,000 strokes.

A pipette with a PE seal operated for 2.5 million strokes before a major leak occurred. However, a very small leak (shown with a 15 minutes test) starting at 350,000 strokes.

The small amount of creep exhibited by UHMWPE actually helps the seal to adapt to the shape of the piston. Excellent elasticity allows the UHMWPE seal to maintain a tight fit against the piston. Following a 24 hour period of initial setting, the UHMWPE seal adapts to irregularities in the shape of the piston 24 and forms a superior seal. Applying a small amount of grease, however, further reduces friction and prevents air leakage. Since the surface of the UHMWPE is more adherent to grease than PTEF, grease will be retained in seal surface irregularities for a much longer time.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A piston seal assembly for a pipette having a body, a piston, and a spring, the body including a shaft segment and a housing segment, the shaft segment defining a bore, the housing segment defining a cavity which is coaxial with the bore, the cavity having an inner surface and defining a shoulder, the piston including a rod segment disposed within the body, an operator segment disposed exterior to the body, and an engagement member disposed intermediate the rod and operator segments, the spring being disposed within the cavity and providing a biasing force between the shoulder of the body and the engagement member of the piston, the seal assembly comprising:

an O-ring having radially inner and outer surfaces and axially separated first and second surfaces, the radially inner surface defining an opening, the first surface being adapted for engaging the shoulder;

an integral, one-piece, substantially circular seal composed of UHMWPE having a radially extending rim portion and an axially extending sleeve portion, the sleeve portion extending axially through the opening of the O-ring and having radially inner and outer surfaces, the radially outer surface of the sleeve portion engaging the radially inner surface of the O-ring, the radially inner surface of the sleeve portion being adapted for slidably engaging the rod segment of the piston, the rim portion having axially separated first and second surfaces, the first surface of the rim portion engaging the second surface of the O-ring; and an integral, one-piece, substantially circular seat having a radially extending engagement portion and an axially extending indexing portion, the indexing portion having radially inner and outer surfaces, the engagement portion having axially separated first and second surfaces and defining an opening adapted for receiving the rod segment of the piston, the first surface of the engagement portion engaging the second surface of the rim portion, the second surface of the engagement portion being adapted for engaging an end of the spring, the radially inner surface of the indexing portion engaging the radially outer surface of the O-ring, the radially outer surface of the indexing portion being adapted for engaging the inner surface of the cavity.

2. The piston seal assembly of claim 1 wherein the O-ring is deformable by the biasing force of the spring whereby the radially inner surface of the O-ring urges the sleeve portion of the seal into sealing engagement with the rod segment of the piston and the radially outer surface of the O-ring urges the indexing portion of the seat into sealing engagement with the surface of the cavity.

3. The piston seal assembly of claim 1 wherein the O-ring is composed of rubber.

4. A pipette comprising:

a body including a shaft segment and a housing segment, the shaft segment defining a bore, the housing segment defining a cavity which is coaxial with the bore, the cavity having an inner surface and defining a shoulder;

a piston including a rod segment disposed within the body, an operator segment disposed exterior to the body, and an engagement member disposed intermediate the rod and operator segments;

a spring having opposite first and second ends, the first end engaging the engagement member of the piston; and a seal assembly including an O-ring having radially inner and outer surfaces and axially separated first and second surfaces, the radially inner surface defining an opening, the first surface engaging the shoulder of the body;

an integral, one-piece, substantially circular seal composed of UHMWPE having a radially extending rim portion and an axially extending sleeve portion, the sleeve portion extending axially through the opening of the O-ring and having radially inner and outer surfaces, the radially outer surface of the sleeve portion engaging the radially inner surface of the O-ring, the radially inner surface of the sleeve portion defining an opening receiving the rod segment of the piston, the radially inner surface slidably engaging the rod segment of the piston, the rim portion having axially separated first and second surfaces, the first surface of the rim portion engaging the second surface of the O-ring, and an integral, one-piece, substantially circular seat having a radially extending engagement portion and an axially extending indexing portion, the indexing portion having radially inner and outer surfaces, the engagement portion having axially separated first and second surfaces and defining an opening receiving the rod segment of the piston, the first surface of the engagement portion engaging the second surface of the rim portion, the second surface of the engagement portion engaging the second end of the spring, the radially inner surface of the indexing portion engaging the radially outer surface of the O-ring, the radially outer surface of the indexing portion engaging the a surface of the cavity;

wherein the O-ring is deformed by the biasing force of the spring whereby the radially inner surface of the O-ring urges the sleeve portion of the seal into sealing engagement with the rod segment of the piston and the radially outer surface of the O-ring urges the indexing portion of the seat into sealing engagement with the inner surface of the cavity.

5. A piston seal assembly for a pipette having a body, a piston, and a spring, the body including a shaft segment and a housing segment, the shaft segment defining a bore, the housing segment defining a cavity which is coaxial with the bore, the cavity having an inner surface and defining a shoulder, the piston including a rod segment disposed within the body, an operator segment disposed exterior to the body, and an engagement member disposed intermediate the rod and operator segments, the spring being disposed within the cavity and providing a biasing force between the shoulder of the body and the engagement member of the piston, the seal assembly comprising:

an O-ring composed of rubber having radially inner and outer surfaces and axially separated first and second surfaces, the radially inner surface defining an opening, the first surface being adapted for engaging the shoulder;

an integral, one-piece, substantially circular seal composed of UHMWPE having a radially extending rim portion and an axially extending sleeve portion, the sleeve portion extending axially through the opening of the O-ring and having radially inner and outer surfaces, the radially outer surface of the sleeve portion engaging the radially inner surface of the O-ring, the radially inner surface of the sleeve portion being adapted for slidably engaging the rod segment of the piston, the rim portion having axially separated first and second surfaces, the first surface of the rim portion engaging the second surface of the O-ring; and an integral, one-piece, substantially circular seat having a radially extending engagement portion and an axially extending indexing portion, the indexing portion having radially inner and outer surfaces, the engagement portion having axially separated first and second surfaces and defining an opening adapted for receiving the rod segment of the piston, the first surface of the engagement portion engaging the second surface of the rim portion, the second surface of the engagement portion being adapted for engaging an end of the spring, the radially inner surface of the indexing portion engaging the radially outer surface of the O-ring, the radially outer surface of the indexing portion being adapted for engaging the inner surface of the cavity.

* * * * *